US007093394B1

(12) United States Patent
McNamara et al.

(10) Patent No.: US 7,093,394 B1
(45) Date of Patent: Aug. 22, 2006

(54) ACM SOFFIT CLIP ASSEMBLY

(75) Inventors: Michael R. McNamara, Mequon, WI (US); Paul A. Olson, Cedarburg, WI (US)

(73) Assignee: Milwaukee Sign Co., L.L.C., Grafton, WI (US)

( * ) Notice: Subject to any disclaimer, the term of this patent is extended or adjusted under 35 U.S.C. 154(b) by 125 days.

(21) Appl. No.: 10/418,638

(22) Filed: Apr. 18, 2003

Related U.S. Application Data

(60) Provisional application No. 60/374,233, filed on Apr. 19, 2002.

(51) Int. Cl.
*A47K 3/16* (2006.01)
*E04D 13/072* (2006.01)

(52) U.S. Cl. ..... 52/35; 52/520; 248/48.2

(58) Field of Classification Search ..... 52/35, 52/95, 519, 520, 545, 60, 11, 12; 248/48.1, 248/48.2, 222.11
See application file for complete search history.

(56) References Cited

U.S. PATENT DOCUMENTS

| | | | | | |
|---|---|---|---|---|---|
| 2,483,888 | A | * | 10/1949 | Danielson | 52/35 |
| 2,511,083 | A | * | 6/1950 | Small | 52/547 |
| 3,748,815 | A | | 7/1973 | Parker | |
| 3,874,131 | A | | 4/1975 | Webster | |
| 3,977,048 | A | | 8/1976 | Benedetti | |
| 4,092,766 | A | | 6/1978 | Meyer | |
| 4,122,762 | A | | 10/1978 | Williams | |
| 4,461,128 | A | | 7/1984 | Knoebl | |
| 4,546,586 | A | | 10/1985 | Knudson | |
| 4,549,375 | A | * | 10/1985 | Nassof | 52/39 |
| 4,580,374 | A | | 4/1986 | Quinnell | |
| 4,622,789 | A | | 11/1986 | Quinnell | |
| 4,635,413 | A | | 1/1987 | Hansen et al. | |
| 4,745,666 | A | | 5/1988 | Murphy | |
| 4,819,390 | A | | 4/1989 | Capper et al. | |
| 4,947,609 | A | * | 8/1990 | Champagne | 52/545 |
| 5,077,952 | A | | 1/1992 | Moore | |
| 5,347,691 | A | | 9/1994 | Terazoe | |
| 5,377,463 | A | | 1/1995 | Howe | |
| 5,392,579 | A | | 2/1995 | Champagne | |
| 5,526,553 | A | | 6/1996 | Klein | |
| 5,537,791 | A | * | 7/1996 | Champagne | 52/520 |
| 5,946,864 | A | | 9/1999 | Simpson | |
| 5,956,913 | A | * | 9/1999 | Nicholson | 52/520 |
| 6,138,418 | A | | 10/2000 | Dyer et al. | |
| 6,272,797 | B1 | * | 8/2001 | Finger | 52/94 |
| 2001/0020349 | A1 | | 9/2001 | Richardson | |

FOREIGN PATENT DOCUMENTS

| | | |
|---|---|---|
| GB | 2231347 | * 11/1990 |

* cited by examiner

*Primary Examiner*—Kimberly Wood
*Assistant Examiner*—Tan Le
(74) *Attorney, Agent, or Firm*—Andrus, Sceales, Starke & Sawall, LLP

(57) ABSTRACT

A mounting clip is provided for enabling a snap fit attachment of an ACM fascia to an existing building fascia. The mounting clip includes at least one flexible arm integrally attached to a base portion so as to allow the flexible arm to move away from one of the fascia. At least one locking finger is integrally attached to the flexible arm by a hinge structure biasing the locking finger into snap fit attachment into a groove on one of the fascia.

9 Claims, 6 Drawing Sheets

ACM SOFFIT CLIP ASSEMBLY

CROSS REFERENCE TO RELATED APPLICATION

This application is based on and claims priority from provisional U.S. Ser. No. 60/374,233 filed Apr. 19, 2002.

BACKGROUND AND SUMMARY OF THE INVENTION

The present invention generally relates to a method and apparatus for attaching a sheet of ACM (aluminum clad material) new or replacement material to an existing building fascia. More specifically, the present invention relates to the method and apparatus of installing a new fascia over an existing fascia, particularly along buildings such as gas stations.

It is one object of the present invention to provide a mounting clip which permits relatively uncomplicated and effective snap fit attachment of a new fascia material over an existing fascia material.

It is also an object of the present invention to provide a mounting clip which is used to modify the appearance of porticos, columns and awnings.

It is a further object of the present invention to provide a mounting clip for holding together L-shaped adjacent members.

In one object of the invention, a mounting clip is provided for enabling a snap fit attachment of a first member to a second member. The clip includes a base portion, and at least one flexible arm integrally attached to the base portion so as to allow the flexible arm to move away from one of the first and second members. At least one locking finger is integrally joined to the flexible arm by a hinge structure biasing the locking finger into snap fit attachment with a groove on one of the first and second members.

In a preferred embodiment of the invention, the base portion includes a vertical leg interposed between the first member and the second member. The flexible arm is attached to the vertical leg by a first hinge portion. Fasteners are passed through the flexible arm and the vertical leg and threaded into the first member. The locking finger is joined to the flexible arm by a second hinge portion bearing against one portion of the second member and biasing the locking finger into snap attachment with the groove in another portion of the second member. The flexible arm extends downwardly and away from the other portion of the second member. The locking finger extends upwardly and towards the other portion of the second member. A bottom lip is integrally attached to the vertical leg and extends away from the flexible arm. The bottom lip underlies the first member. The bottom lip and the one portion of the second member are substantially coplanar.

In alternative embodiments of the invention, each of the first and second members have a first leg disposed generally perpendicularly to a second leg, the first legs being positioned in back to back relationship with one another. The at least one flexible arm includes a pair of side support walls, each extending to one side of a first leg from one of the opposed ends on the base portion, each of the side support walls having the locking finger.

In another aspect of the invention, a mounting clip enables a snap fit attachment of a first member to a second member. Each of the first and second members have a first leg disposed generally perpendicularly to a second leg. The first legs are positioned in back to back relationship with one another. The clip includes a connecting wall having opposed ends and a pair of side support walls, each extending to one side of a first leg from one of the opposed ends of the connecting wall. At least one of the side support walls includes a locking finger which is deflectable about a hinge to engage a groove formed in at least one of the first legs.

In another aspect of the invention, a mounting clip is fastened to a first member for enabling a snap fit attachment of a second member to the first member. The clip includes a vertical leg interposed between the first member and the second member. A flexible arm is integrally attached to the vertical leg by a first hinge portion allowing the flexible arm to move outwardly away from the second member. A locking finger is integrally joined to the flexible arm by a second hinge portion bearing against one portion of the second member and biasing the locking finger into snap fit attachment with a groove on another portion of the second member. The first member takes the form of an existing building fascia and the second member is defined by a ACM fascia. The ACM fascia includes a vertical front face, a horizontal bottom edge and a locking lip. The locking lip is secured between the locking finger and the vertical leg.

In yet another aspect of the invention, a mounting clip is provided for enabling a snap fit attachment of a first member to a second member. Each of the first and second members have a first leg disposed generally perpendicularly to a second leg, the first legs being positioned in back to back relationship with one another. The clip includes a linear connecting wall having opposed ends, and a pair of flexible side support walls each extending to one side of a first leg from one of the imposed ends of the connecting wall. Each of the support walls include a locking finger which is deflectable about a hinge bearing against the second leg and biasing the locking finger into snap fit attachment in a groove on the first leg.

In yet another aspect of the invention, a mounting clip is provided for enabling a snap fit attachment of a first member to a second member. Each of the first and second members have a first leg disposed generally perpendicularly to a second leg, the first legs being positioned in back to back relationship with one another. The clip includes a curved connecting wall having opposed ends and a pair of flexible side support walls, each extending to one side of a first leg from one of the opposed ends of the connecting wall. Each of the support legs include a locking finger which is deflectable about a hinge bearing against the second leg and biasing the locking finger into snap fit attachment in a groove on the first leg.

In a further aspect of the invention, a mounting clip is provided for enabling a snap fit attachment of a first member to a second member. The clip includes a linear connecting wall having opposed ends and a pair of rigid side support webs, each extending to one side of a first leg from one of the ends of the connecting wall. Each of the support webs has a locking finger engageable with a groove on one of the first legs. One of the locking fingers is biased into a snap fit attachment in the groove.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
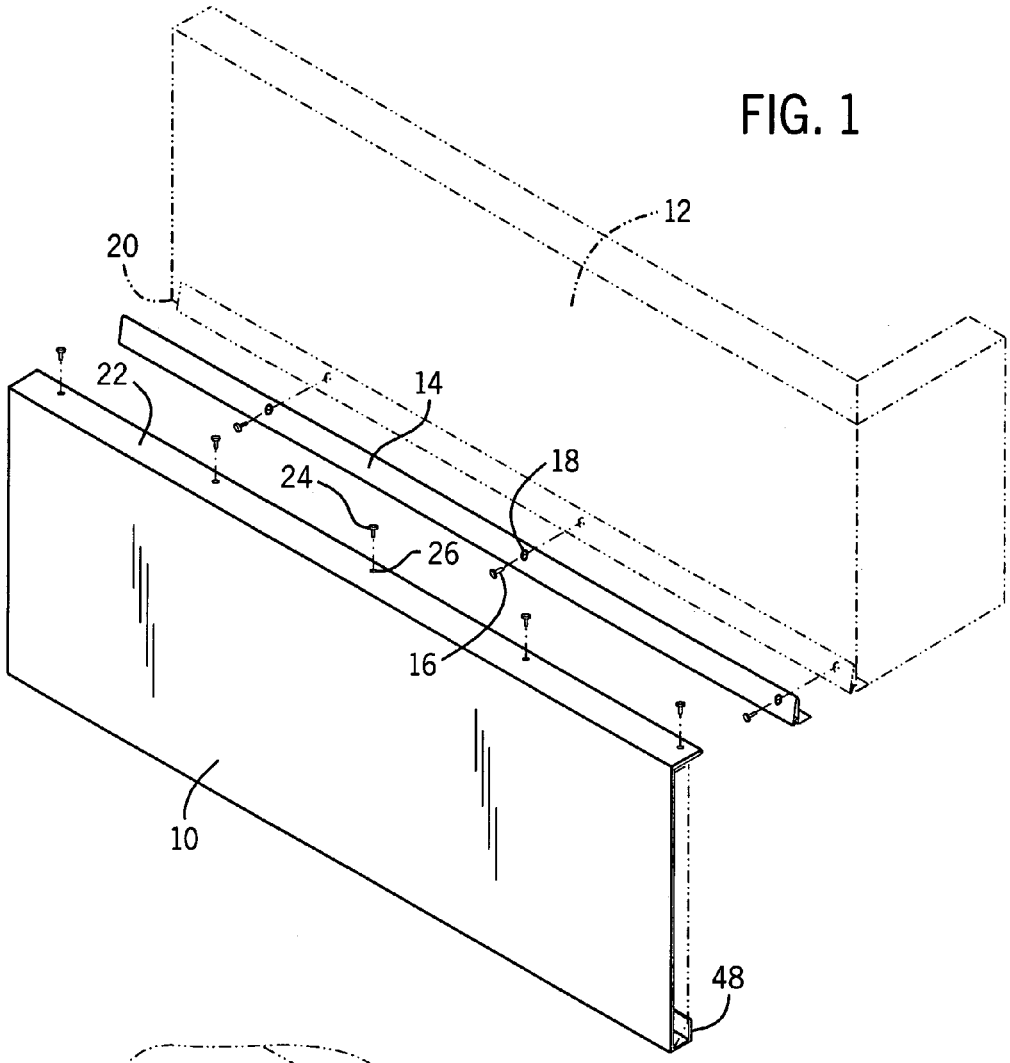
FIG. 1 is a perspective view of a mounting clip used in the mounting of a new ACM fascia over an existing building fascia.
Figure 1A:
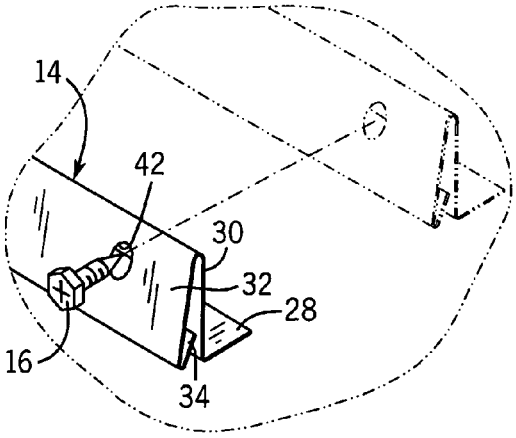
FIG. 1A is an enlarged detail view of the mounting clip being attached to the existing building fascia.

FIGS. 1 and 1A illustrate the method and apparatus of the present invention for securing a sheet of ACM (aluminum clad material) new or replacement fascia material 10 to an existing building fascia 12. The ACM fascia material 10 is used to change the fascia of a building, such as if the building changes ownership or the advertising signage is changed. The method and apparatus of the present invention allows the new fascia material 10 to be installed over the existing building fascia 12 quickly and easily while providing a desirable appearance.

The present invention contemplates the use of a soffit mounting clip 14 that is attached to the building fascia by a plurality of connectors 16. Each of the connectors 16 passes through a hole 18 formed in the soffit clip 14. Once the soffit clip 14 has been securely installed along the lower edge 20 of the building fascia 12, the new, ACM fascia material 10 can be quickly and easily installed. As illustrated in FIG. 1, the top edge 22 of the new fascia material 10 is attached to the building fascia 12 by a plurality of connectors 24 that pass through holes 26 and into the top surface of the building fascia 12.

Figure 2:
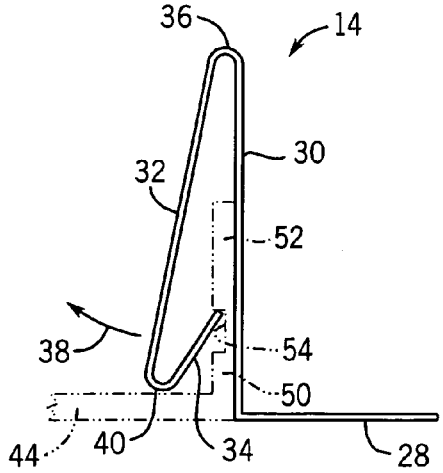
FIG. 2 is a side view of the mounting clip of the present invention.

Referring now to FIG. 2, the soffit clip 14 is formed from aluminum, although other materials are contemplated as being within the scope of the present invention. The soffit clip 14 includes a horizontal bottom lip 28, a vertical leg 30, a flexible arm 32 and a locking finger 34. The soffit clip 14 is formed from a single piece of bent aluminum to define its various components, as illustrated. The flexible arm 32 is attached to the vertical leg 30 by a flexible, first hinge portion 36 that allows the flexible arm to deflect outward as illustrated by arrow 38. Further, the locking finger 34 is attached to the flexible arm 32 by a similar second hinge portion 40 that allows the locking finger 34 to likewise deflect.

As illustrated in FIG. 1A, the vertical leg 30 and the flexible arm 32 include a plurality of access holes 42 that allow screws 16 to attach the soffit clip 14 to the existing building fascia 12. The access holes 42 are equally spaced along the length of the soffit clip 14 as illustrated. Although access holes 42 are illustrated in the embodiment of the invention shown, the soffit clip 14 could be attached by connectors that pass through either the vertical leg 30 or the bottom lip 28. In addition, the soffit clip 14 could be attached by adhesive.

Figure 4:
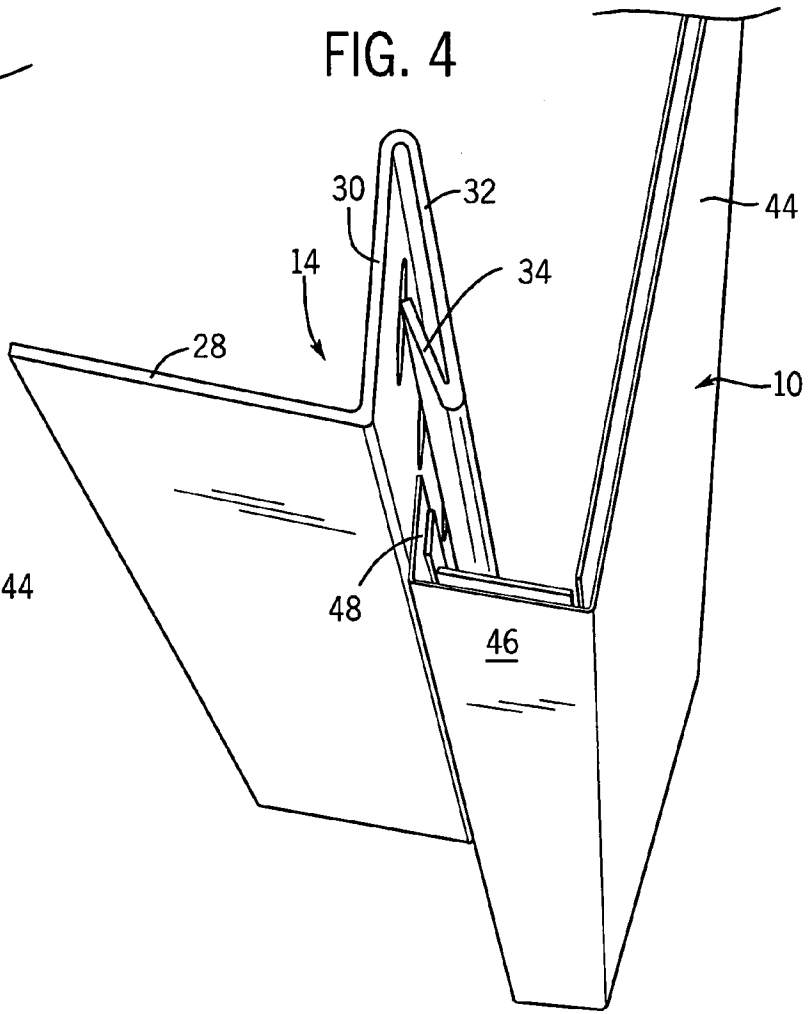
FIG. 4 is a perspective view illustrating the insertion of the fascia into the mounting clip.
Figure 3:
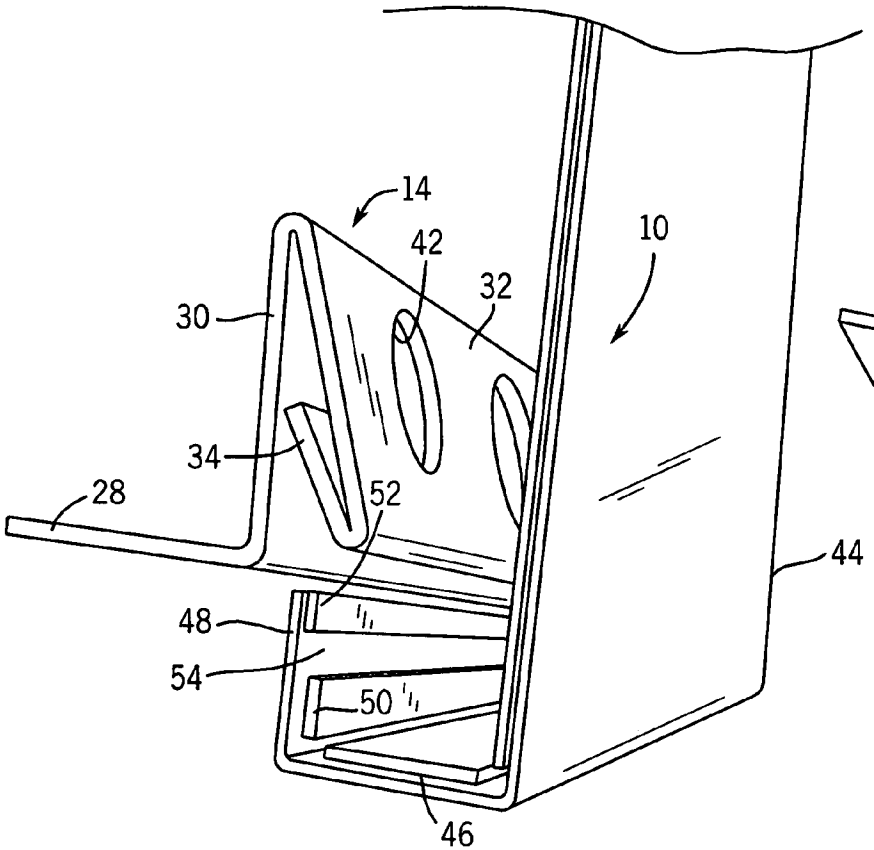
FIG. 3 is a partial perspective view of the mounting clip and ACM fascia.

Referring now to FIG. 3, the ACM fascia material 10 generally includes a vertical front face 44, a horizontal bottom edge 46 and a vertical locking lip 48. The locking lip 48 includes a bottom ridge 50 and a top ridge 52 that define a locking groove 54 therebetween. As illustrated in FIG. 4, when the fascia material 10 is installed into the soffit clip 14, the locking lip 48 is received between the locking finger 34 and the vertical leg 30.

Figure 5:
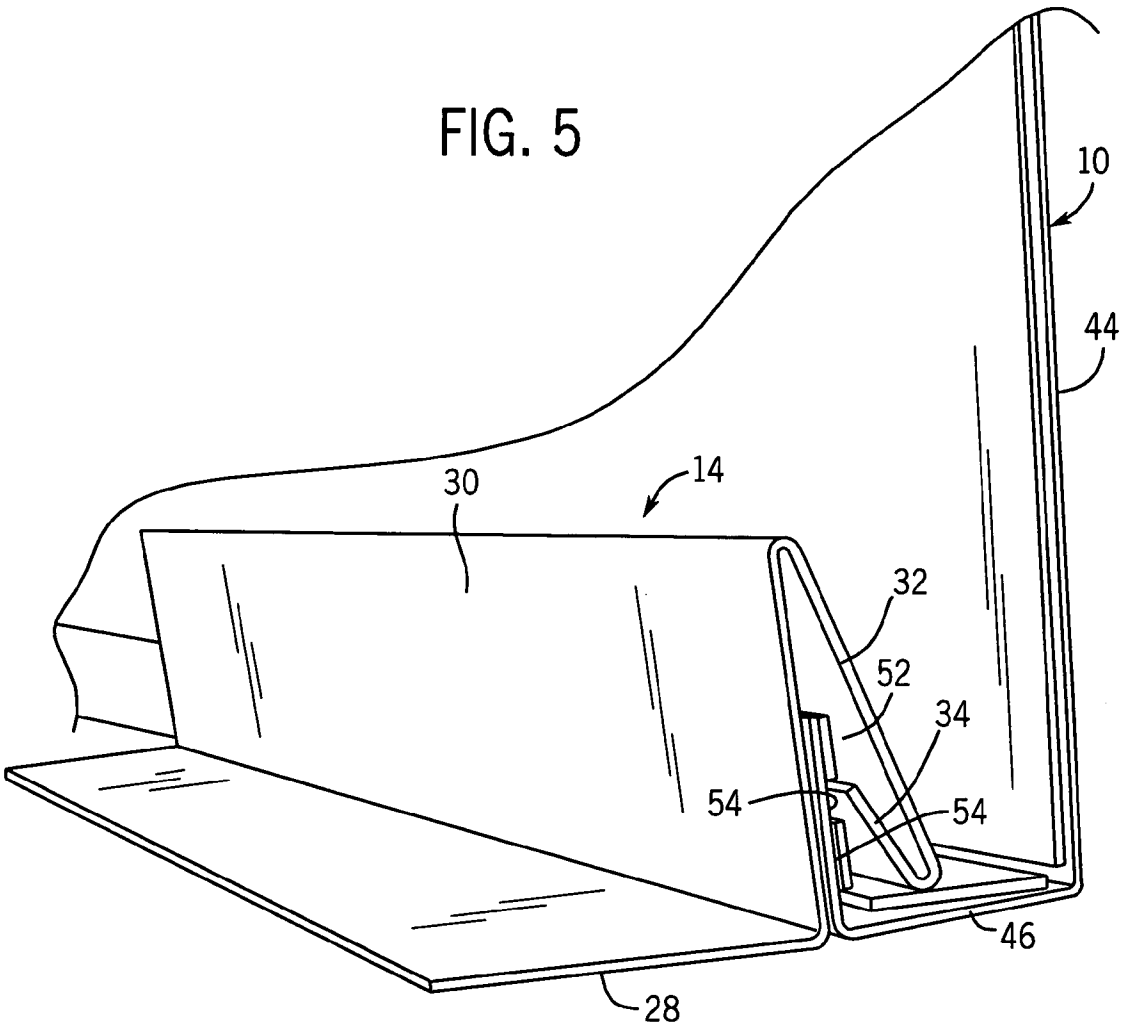
FIG. 5 is a back view of the mounting clip and ACM fascia.

Referring to FIGS. 2 and 5, the locking finger 34 is received between the lower ridge 50 and upper ridge 52 within the locking groove 54. In this manner, the soffit clip 14 securely holds the locking lip 48 of the fascia material 10.

Referring back to FIG. 1, during installation, the soffit clip 14 is first installed on the building fascia 12. Once installed, the locking lip 48 is pushed up into the soffit clip 14 to secure the new fascia 10 to the existing building fascia 12.

Figure 7:
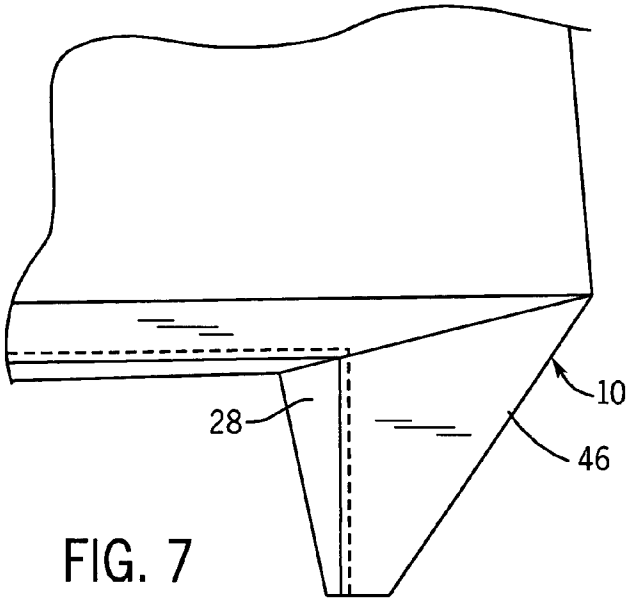
FIG. 7 is a bottom view illustrating the smooth transition between the ACM fascia and the mounting clip.
Figure 6:
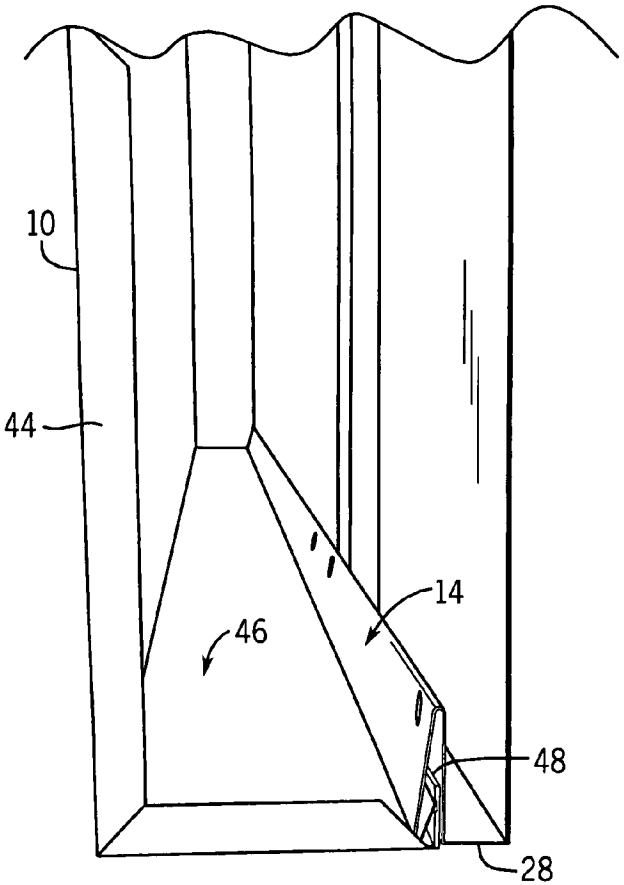
FIG. 6 is an end perspective view illustrating the mounting clip and ACM fascia as installed.

Referring now to FIGS. 6 and 7, when the ACM fascia material 10 is installed, the bottom edge 46 forms a smooth transition with the bottom lip 28 of the soffit clip 14. The smooth transition provides a visually pleasing appearance and allows the ACM fascia material 10 to be installed over existing building fascia.

Figure 8:
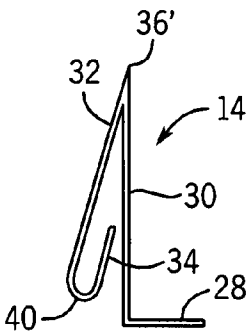
FIG. 8 is a side view illustrating the use of a first alternative embodiment of the mounting clip.

Referring to FIG. 8, thereshown is a first alternative embodiment of the invention which is similar to that described in FIGS. 1–7 except that the hinge portion 36' comes to a sharp point at the top of the clip 14.

Figure 9:
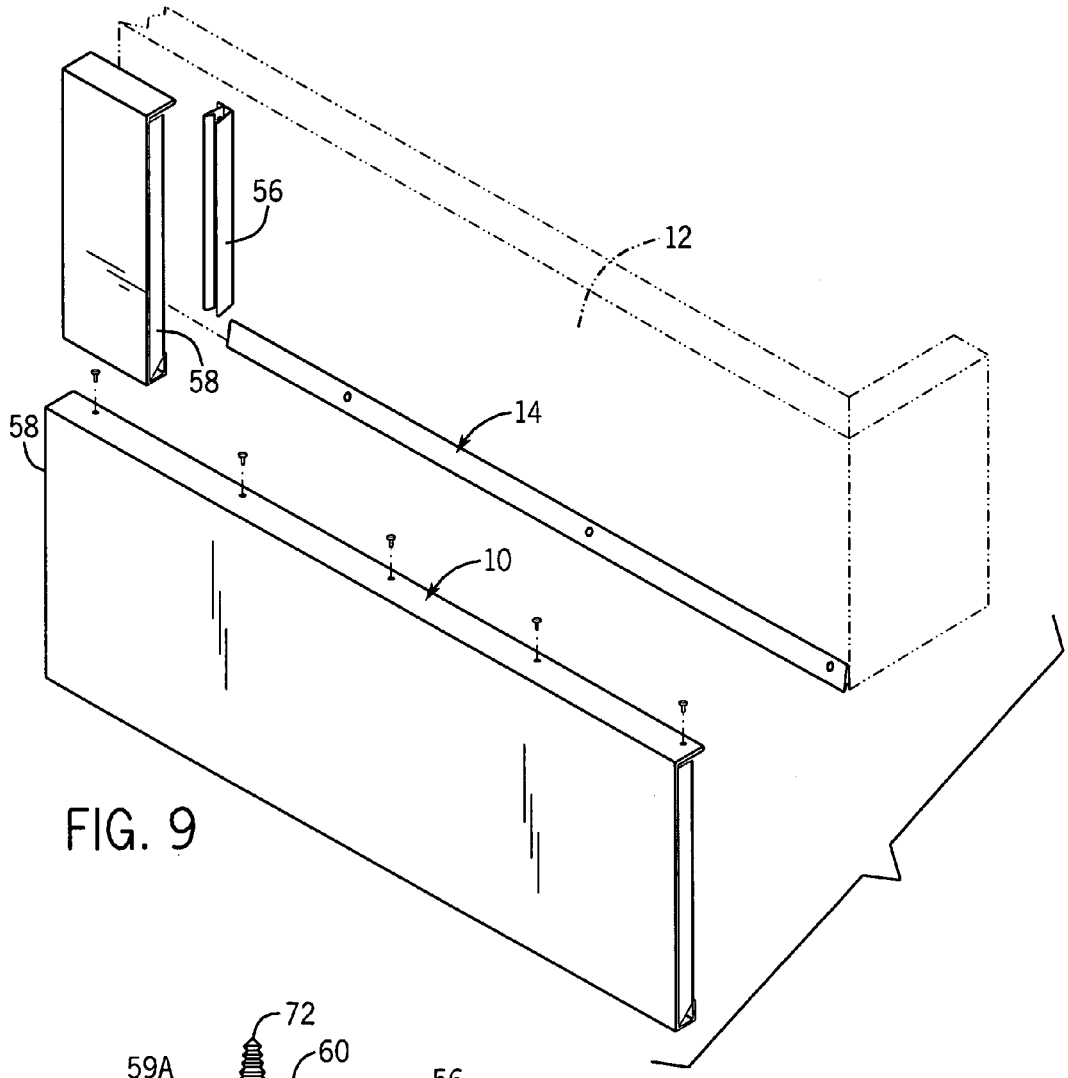
FIG. 9 is a perspective view illustrating the use of a second alternative embodiment of a mounting clip to secure adjacent sections of ACM fascia.
Figure 10A:
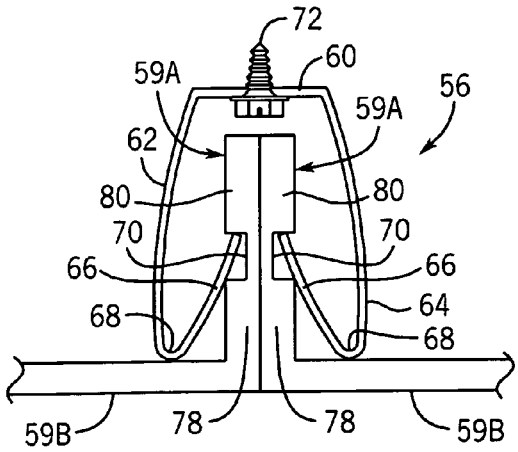
FIGS. 10A and 10B are end views illustrating the mounting clip of FIG. 9.
Figure 10B:
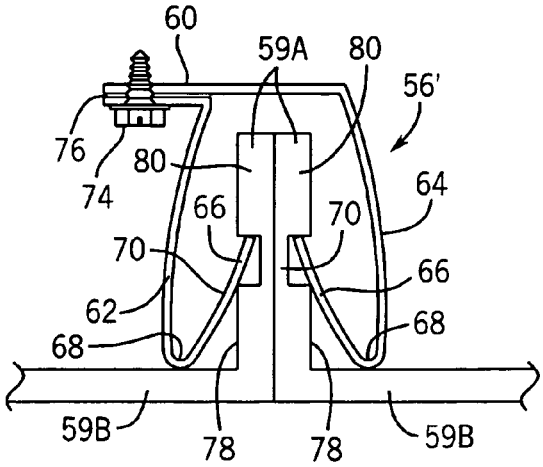

Referring now to FIGS. 9, 10A and 10B, thereshown is a second alternative embodiment of the invention defined by vertical mounting clip 56 used to secure the sides 58 of adjacent sections of fascia material 10. The sides 58 each have a first leg 59A disposed generally perpendicularly to a second leg 59B, the first legs 59A being positioned in back to back relationship with one another. The vertical clip 56 provides for a clean, decorative appearance between the adjacent sections of fascia material. The vertical clip 56 includes a linear or connecting back wall 60 and a pair of extending side support walls 62 and 64 acting as flexible arms. The side support walls 62, 64 each include a locking finger 66 that can deflect inward about the hinge 68. The locking finger 66 formed on each side support wall 62, 64 engages the locking groove 70 formed in the legs 59A of the fascia 10. As can be understood in FIG. 10A, the locking fingers 66 are received within the locking groove 70 to secure the sides of the fascia 10 as indicated.

The vertical clip 56 can include a connector 72 (FIG. 10A) that passes through the back wall 60 or a connector 74 (FIG. 10B) that passes through a pair of side flanges 76, one extending from the back wall 60 and the other extending from the support wall 62. In either case, the vertical clip 56 is secured to the building fascia 12.

Although the vertical clip 56 is illustrated as attached to the building fascia 12, it is contemplated that the vertical clip 56 does not have to be attached to the building. Instead, the vertical clip 56 could be used between sheets of material to create an even vertical surface having flush joints even when the existing fascia is out of plumb and square.

As illustrated in FIG. 9, the vertical clip 56 extends along only a portion of the length of the building fascia 12. However, it is contemplated by the inventors that the length of the vertical clip 56 could be lengthened or shortened, depending upon the particular use.

As illustrated in FIG. 10A, the legs 59A of each fascia member 10 include both a first ridge 78 and a second ridge 80 that define the locking groove 70. This configuration is similar to the bottom end of the fascia, as previously described.

Figure 11:
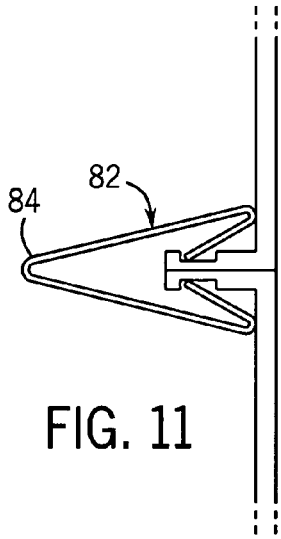
FIG. 11 is an end view illustrating a third alternative embodiment of the mounting clip.

Referring now to FIG. 11, a third alternative embodiment of the invention is shown in the form of a vertical mounting clip 82 which is similar to the clip 56 except that the connecting wall 84 is curved.

Figure 12:
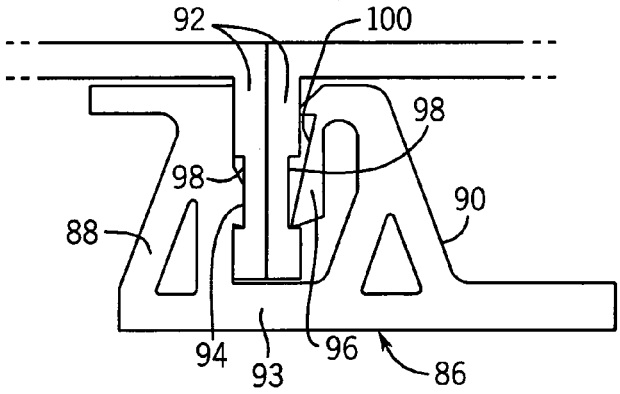
FIG. 12 is an end view of a fourth alternative embodiment of the mounting clip.

In FIG. 12, a fourth alternative embodiment of the invention is defined by a mounting clip 86 having a pair of substantially rigid side support webs 88, 90, each extending to one side of a first leg 92 from one of the ends of the linear connecting wall 93. Each of the support webs 88, 90 has a locking finger 94, 96 engageable with a groove 98 on one of the first legs 92. One of the locking fingers 96 is biased into snap fit attachment in the groove 98 by a living hinge 100 provided on support web 90.

Figure 13:
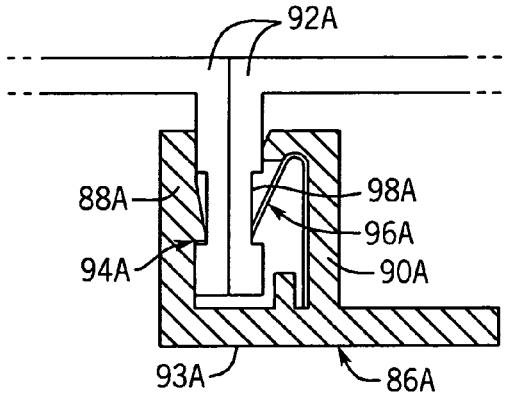
FIG. 13 is an end view of a fifth alternative embodiment of the invention.

FIG. 13 is a fifth alternative embodiment similar to the embodiment of FIG. 12 and shows a mounting clip 86A having a pair of substantially rigid side support webs 88A, 90A, each extending to one side of a first leg 92A from one of the end of linear connecting wall 93A. Each of the support webs 88A, 90A has a locking finger 94A, 96A engageable with a groove 98A on one of the first legs 92A. One of the locking fingers 96A is spring biased into snap fit attachment in the groove 98A.

As can be understood by the foregoing description, the soffit mounting clip 14 and the vertical mounting clips 56, 82, 86 and 86A allow the ACM fascia material to be quickly and easily connected to the existing building fascia. Further, the mounting clip 14 allows the fascia material to be installed while presenting an attractive appearance when viewed from the bottom.

Various alternatives and embodiments are contemplated as being within the scope of the following claims particularly pointing out and distinctly claiming the subject matter regarded as the invention.

We claim:

1. A mounting clip in combination with a first member and a second member having a horizontal bottom edge and a vertical locking lip for enabling a snap fit attachment of the first member to the second member, the clip comprising:

a base portion having a planar, horizontally extending bottom lip and a vertical leg;

at least one flexible arm integrally attached to the vertical leg so as to allow the flexible arm to move away from one of the first and second members; and at least one locking finger extending externally of the second member and integrally joined to the flexible arm by a first hinge portion biasing a free end of the locking finger into snap fit attachment with a groove formed on the vertical lip of the second member;

wherein the locking finger is joined to the flexible arm by a second hinge portion bearing against the horizontal bottom edge of the second member and biasing the free end of locking finger into snap fit attachment with the groove on the vertical locking lip of the second member, wherein the planar bottom lip is integrally attached to the vertical leg at a 90° angle and extends away from the flexible arm, wherein the planar bottom lip and the horizontal bottom edge of the second member are substantially coplanar in a plane substantially perpendicular to the vertical leg, wherein the planar bottom lip underlies and engages the first member, and wherein fasteners are passed through the flexible arm and the vertical leg and threaded into the first member.

2. The clip of claim 1, wherein the base portion includes a vertical leg interposed between the first member and the second member.

3. The clip of claim 1, wherein the flexible arm is attached to the vertical leg by the first hinge portion.

4. The clip of claim 1, wherein the flexible arm extends downwardly and away from the other portion of the second member.

5. The clip of claim 1, wherein the locking finger extends upwardly and towards the other portion of the second member.

6. A mounting clip in combination with a first member and a second member having a horizontal bottom edge and a vertical locking lip, the mounting clip being fastened to the first member for enabling a snap fit attachment of the second member to the first member, the clip comprising:

a vertical leg interposed between the first member and the second member;

a planar, horizontally extending bottom lip integrally attached to the vertical leg, the bottom lip underlying and engaging the first member;

a flexible arm integrally attached to the vertical leg by a first hinge portion allowing the flexible arm to move outwardly away from the second member; and a locking finger integrally joined to the flexible arm by a second hinge portion bearing against the horizontal bottom edge of the second member and biasing a free end of the locking finger into snap fit attachment with a groove formed on the vertical lip of the second member, the vertical lip of the second member having an elongated top ridge spaced from an elongated bottom ridge and defining the groove therebetween;

wherein fasteners are passed through the flexible arm and the vertical leg, and threaded into the first member.

7. The clip of claim 6, wherein the first member takes the form of an existing building fascia and the second member is defined by a replacement fascia.

8. The clip of claim 7, wherein the replacement fascia includes a vertical front face, the horizontal bottom edge and the locking lip.

9. The clip of claim 8, wherein the locking lip is received between the locking finger and the vertical leg.

* * * * *